US007004750B2

(12) United States Patent
Luo

(10) Patent No.: US 7,004,750 B2
(45) Date of Patent: Feb. 28, 2006

(54) IGNITION UNIT FOR DISPOSABLE CHILDPROOF LIGHTER

(76) Inventor: Chun Wen Luo, Luoshui Industrial Zone, Xing Tan Town, Shunde City, Guang Dong (CN)

( * ) Notice: Subject to any disclaimer, the term of this patent is extended or adjusted under 35 U.S.C. 154(b) by 0 days.

(21) Appl. No.: 10/400,143

(22) Filed: Mar. 27, 2003

(65) Prior Publication Data

US 2004/0191714 A1 Sep. 30, 2004

(51) Int. Cl.
*F23Q 2/46* (2006.01)

(52) U.S. Cl. ..... 431/153; 431/276

(58) Field of Classification Search ..... 431/153, 431/144, 138, 277, 276, 274, 273, 267, 255
See application file for complete search history.

(56) References Cited

U.S. PATENT DOCUMENTS 5,547,370 A * 8/1996 Hwang ..... 431/276
5,769,625 A * 6/1998 Sher ..... 431/153
5,882,186 A * 3/1999 Kai Man ..... 431/153
6,220,853 B1 * 4/2001 Luo ..... 431/153
6,352,429 B1 * 3/2002 Sher ..... 431/153

FOREIGN PATENT DOCUMENTS

WO WO 98/04869 A1 * 2/1998

* cited by examiner

*Primary Examiner*—Josiah C. Cocks
(74) *Attorney, Agent, or Firm*—Raymond Y. Chan; David and Raymond

(57) ABSTRACT

An ignition unit, which is incorporated with a disposable childproof lighter, includes a striker wheel for urging against a flint, two driven gear elements coaxially mounted at two sides of the striker wheel, and two driving caps mounted between the driven gear elements and the striker wheel. Each of the driving caps has an outer circumferential slipping surface and a driving cavity for receiving a gear wheel of each driven gear element wherein the driving caps are arranged to engage with the gear wheels to drive the driven gear elements to rotate respectively, so as to drive the striker wheel to rotate for striking against a flint to produce sparks.

9 Claims, 5 Drawing Sheets

IGNITION UNIT FOR DISPOSABLE CHILDPROOF LIGHTER

BACKGROUND OF THE PRESENT INVENTION

1. Field of Invention

The present invention relates to a disposable childproof lighter, and more particularly to an ignition unit for a disposable childproof lighter, wherein a striker wheel must be driven by two driving wheels to rotate, so as to prevent the disposable childproof lighter from being ignited accidentally or by children.

2. Description of Related Arts

Nowadays, both U.S. government and U.S. Consumer Product Safety Commission demand a safety device in every cigarette lighter including the disposable lighter to prevent unwanted ignition accidentally or by a child. As it is known that the disposable lighter is common and relatively cheap, it is impossible to incorporate with expensive and complex safety device that highly increases the cost of the disposable lighter. In order to minimize the manufacturing cost of the disposable lighter employed with the safety device, one of the most common disposable safety lighter is the driving wheel type disposable safety lighter. This type of disposable lighter comprises a pair of driving wheels for driving the striker wheel to rotate in order to generate sparks, wherein the driving wheels normally run idle when the driving wheels are physically disengaged with the striker wheel.

For example, U.S. Pat. No. 5,547,370, owned by Hwang, discloses a wheel axle mounted between two upright supports at the top of a butane wheel, two driving wheels mounted around the wheel axle and disposed in contact with a spring-supported flint below and turned by the driving wheels through the wheel axle to strike the spring-supported flint in producing sparks. The wheel axle is made of polygonal cross section, having two round rods at two opposite ends loosely inserted into a respective axle hole on each upright support so as to ensure a better connection between the striker wheel and the wheel axle.

Since the dimension of the driving wheels are not produced precisely for minimizing the manufacturing cost of the disposable lighter, there is always a clearance between the driving wheel and the striker wheel. The clearance is supposed to provide a gap that the driving wheels can rotate loosely around the axle in such a manner that the driving wheels are run idle around the axle. However, the clearance also provides a gap that the driving wheels can axially loose such that the driving wheels may not perfectly engage with the wheel axle of the striker wheel in order to provide an optimum mutual friction therebetween for ignition. Furthermore, in order to ignite the lighter, a downward force must applied on the driving wheels for engaging the striker wheel. In fact, due to the contacting surface between the driving wheel and the striker wheel, the disposable lighter is somewhat difficult in operation.

Another example, U.S. Pat. No. 6,220,853, owned by Luo, discloses a striker wheel coaxially sandwiched by two driving caps and a pair of driven gear elements coaxially mounted at two sides of the striker wheel respectively, wherein the driving caps are arranged to engage with the driven gear elements respectively to drive the striker wheel to rotate when a downward force is applied on the driving caps. In other words, the driving caps are run idle at a normal position. However, the each of the driving caps has an outer circumferential knurling surface so that the child is able to strike the driving caps on a floor to engage with the driven gear elements and to rotate the striker wheel.

SUMMARY OF THE PRESENT INVENTION

A main object of the present invention is to provide an ignition unit for a disposable childproof lighter, which prevent the disposable childproof lighter from being ignited accidentally or by children.

Another object of the present invention is to provide an ignition unit for a disposable childproof lighter, wherein each driving cap of the ignition unit has a smooth slipping surface so that without sufficient force, the adult's thumb will slip off the driving cap without causing the rotation of the striker wheel, so as to prevent an unintentional ignition of the disposable childproof lighter.

Another object of the present invention is to provide an ignition unit for a disposable childproof lighter, wherein the driving caps are normally disengaged with the driven gear elements respectively so as to prevent any unwanted ignition of the disposable childproof lighter. In other words, the ignition unit provides double safety features in one simple structure to prevent the disposable childproof lighter being ignited unintentionally or by child.

Another object of the present invention is to provide an ignition unit for a disposable childproof lighter, wherein each of the driving caps can be simply modified by its size to normally engage with the driven gear element so as to enhance the ignition operation of the disposable childproof lighter without reducing its safety feature.

Another object of the present invention is to provide an ignition unit for a disposable childproof lighter, wherein the driving caps are steadily held by the driven gear elements respectively for preventing any axially loose of the driving caps, so as to ensure effective engagement of the driving cap to ignite the disposable childproof lighter.

Another object of the present invention is to provide an ignition unit for a disposable childproof lighter, wherein the ignition unit is capable of incorporating with any flint-type disposable lighter to increase the safety thereof.

Another object of the present invention is to provide an ignition unit for a disposable childproof lighter, wherein no expensive or complicated structure is required to employ in the present invention in order to achieve the above mentioned objects. Therefore, the present invention successfully provides an economic and efficient solution for preventing the disposable childproof lighter from being ignited accidentally or by children.

Accordingly, in order to accomplish the above objects, the present invention provides an ignition unit for a disposable childproof lighter which comprises two supporting walls and a flint supported by a resilient element at a position between the two supporting walls, wherein the ignition unit, which is adapted for rotatably mounting between the two supporting walls, comprises:

a striker wheel having a plurality of striking teeth evenly provided on an outer circumferential surface thereof for urging against the flint;

a pair of driven gear elements for coaxially mounting the striker wheel between the two supporting walls, wherein each of the driven gear elements comprises a gear wheel having an outer circumferential surface and a support shank integrally and coaxially protruded from an inner side of the gear wheel, wherein the two support shanks, which are smaller than the two gear wheels in diameter, are coaxially mounted on two sides of the striker wheel to define two supporting gaps between the two sides of the striker wheel and the two gear wheels respectively, and the two gear wheels are arranged for respectively and rotatably mounting to the two supporting walls in such a manner that the striker wheel is capable of being driven to rotate when the two gear wheels are driven to rotate; and a pair of driving caps, each comprising a driving ring and an inner sidewall extending from a circular edge of the driving ring, wherein each of the driving ring has an smooth outer circumferential slipping surface, an inner circumferential surface, and a circular driving cavity formed within the driving ring and the inner sidewall, each of the driving cavities having a diameter larger than that of the gear wheels of the driven gear elements, wherein each of the inner sidewalls has a central support hole for the support shank of the respective driven gear element passing through while the respective gear wheel is received in the driving cavity, wherein the two inner sidewalls of the driving caps are disposed the two supporting gaps respectively so as to hold the two driving caps in a position between the striker wheel and the two driven gear elements respectively, wherein the driving caps are arranged to engage with the gear wheels to drive the driven gear elements to rotate respectively, so as to drive the striker wheel to rotate for striking against the flint to produce sparks.

DETAILED DESCRIPTION OF THE PREFERRED EMBODIMENT

Figure 1:
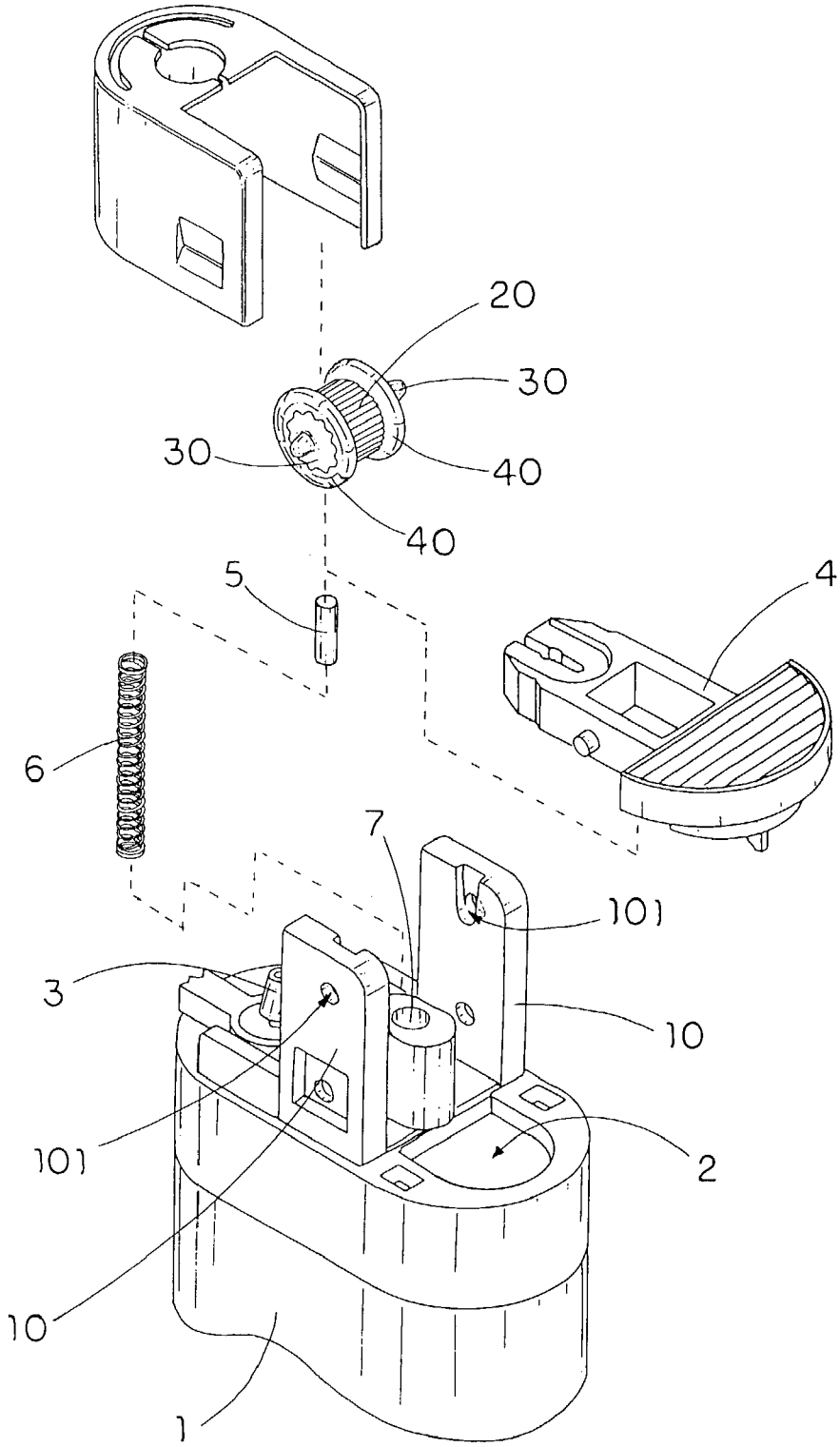
FIG. 1 is a perspective view of an ignition unit for a disposable childproof lighter according to a preferred embodiment of the present invention.

Referring to FIG. 1 of the drawings, an ignition unit, which is adapted for mounting on a disposable childproof lighter, according to a preferred embodiment of the present invention is illustrated, wherein the disposable childproof lighter, such as a conventional disposable lighter, comprises a supporting frame 1 mounted on a gas reservoir 2 which has a gas valve 3 upwardly extended from the supporting frame 1.

The gas valve 3 is actuated by a gas lever 4 to release gas from the gas reservoir 2. The supporting frame 1 comprises a pair of supporting walls 10 parallelly protruded at opposite sides of the gas lever 4 wherein the gas lever 4 is pivotally mounted between the two supporting walls 10 of the supporting frame 1. Each of the supporting walls 10 has a supporting hole 101 provided thereon. A windshield is detachably mounted on the supporting frame 1 to encircle the gas valve 3.

The disposable childproof lighter further comprises a flint 5 supported by a resilient element 6 wherein the flint 5 and the resilient element 6 are received in a flint housing 7 provided between the two supporting walls 10 of the supporting frame 1.

Figure 2:
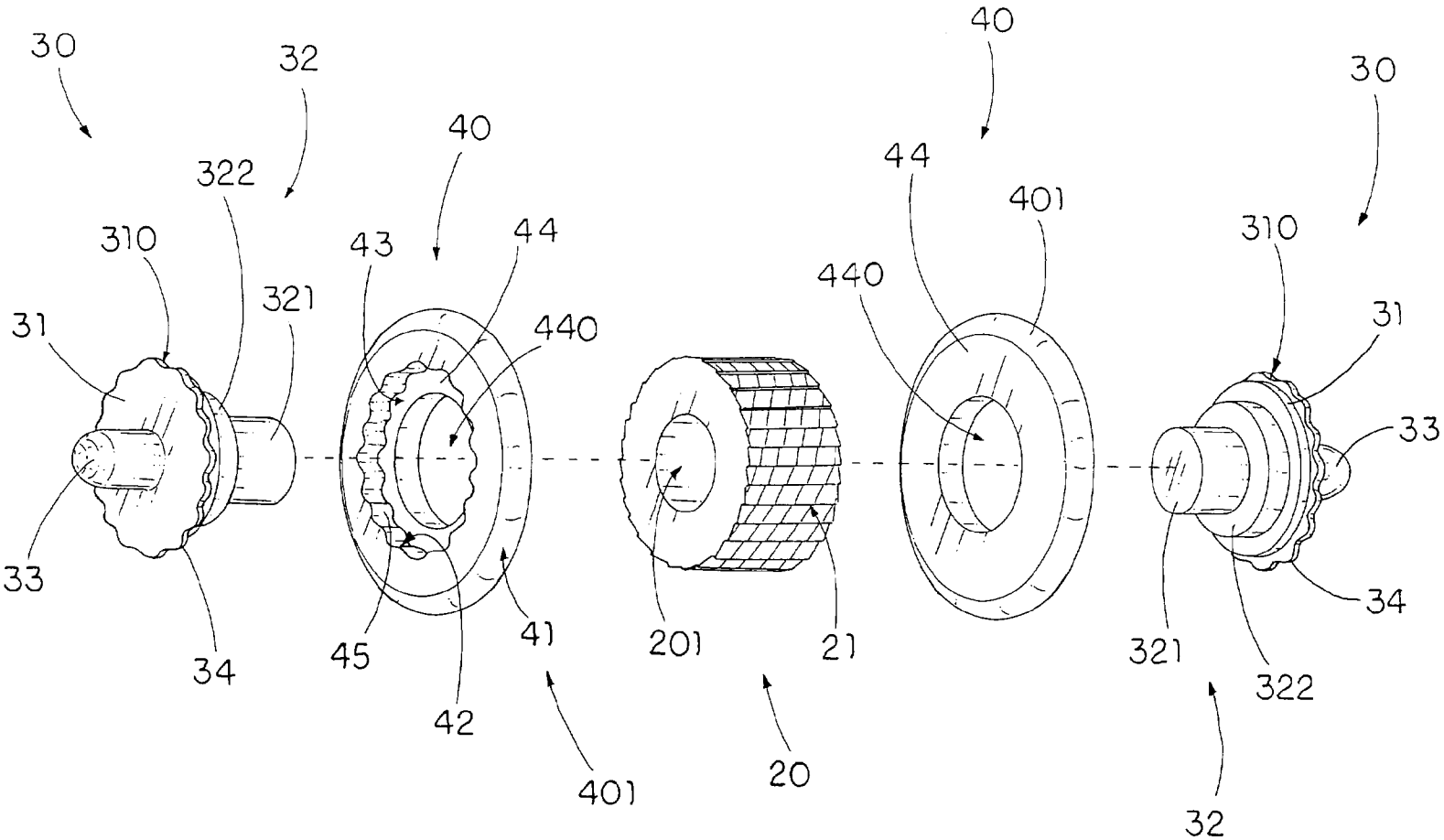
FIG. 2 is an exploded perspective view of the ignition unit for the disposable childproof lighter according to the above preferred embodiment of the present invention.

As shown in FIG. 2, the ignition unit comprises a striker wheel 20 having a plurality of striking teeth 21 evenly provided on an outer circumferential surface thereof for urging against the flint 5, a pair of driven gear elements 30 for coaxially mounting the striker wheel 20 between the two supporting walls 10, and a pair of driving caps 40 for driving the striker wheel 20 to rotate through the driven gear elements 30.

Each of driven gear elements 30 comprises a gear wheel 31 having an outer circumferential surface 310 and a support shank 32 integrally and coaxially protruded from an inner side of the gear wheel 31, wherein the two support shanks 32, which are smaller than the two gear wheels 31 in diameter, are coaxially mounted on two sides of the striker wheel 20 to define two supporting gaps 301 between the two sides of the striker wheel 20 and the two gear wheels 31 respectively. The two gear wheels 31 are arranged for respectively and rotatably mounting to the two supporting walls 10 in such a manner that the striker wheel 20 is capable of being driven to rotate when the two gear wheels 31 are driven to rotate.

Each of the driving caps 40 comprises a driving ring 401 and an inner sidewall 44 extending from a circular edge of the driving ring 401, wherein each of the driving rings 401 has a slipping surface 41 provided on an outer circumferential surface, an inner circumferential surface 42, and a circular driving cavity 43 formed within the driving ring 401 and the inner sidewall 44, wherein each of the driving cavities 43 has a diameter larger than that of the gear wheels 31 of the driven gear elements 30. Each of the inner sidewalls 44 has a central support hole 440 for the support shank 32 of the respective driven gear element 30 passing through while the respective gear wheel 31 is received in the driving cavity 43. The two inner sidewalls 44 of the driving caps 40 are disposed the two supporting gaps 301 respectively so as to hold the two driving caps 40 in a position between the striker wheel 20 and the two driven gear elements 30 respectively, wherein the driving caps 40 are arranged to engage with the gear wheels 31 to drive the driven gear elements 30 to rotate respectively, so as to drive the striker wheel 20 to rotate for striking against the flint 5 to produce sparks.

According to the preferred embodiment, the striker wheel 20, which is a hollow wheel body having a central axial hole 201, is rotatably mounted between the two supporting walls 10 of the supporting frame 1 at a position that the flint 5 is upwardly urged against a portion of the striking teeth 21 in such a manner that the sparks are produced and directed toward the gas valve 3 by driving the striking teeth 21 of the striker wheel 20 to strike against the flint 5.

Each of the support shank 32 comprises a wheel axle 321 and a support wheel 322 which is integrally and coaxially positioned between the gear wheel 31 and the wheel axle 321. The two wheel axles 321, which are smaller than the two gear wheels 31 in diameter, are coaxially fitted into two ends of the central axial hole 201 of the striker wheel respectively. Each of the two support wheels 322 has a diameter slightly larger than the two wheel axles 321 such that when the two wheel axles 321 are fully inserted into the two ends of the central axial hole 201 of the striker wheel 20, the two supporting gaps 301 are exactly defined between the sides of the striker wheel 20 and the two gear wheels 31 respectively.

As shown in FIG. 2, each of the driven gear elements 30 further comprises a supporting shaft 33 coaxially and outwardly extended from the respective gear wheel 31 to rotatably insert into the supporting hole 101 of the respective supporting wall 10. Therefore, the two gear wheels 31 are respectively and rotatably mounted to the two supporting walls 10 of the supporting frame 1 respectively in such a manner that the striker wheel 20 is capable of being driven to rotate when the two gear wheels 31 are driven to rotate.

Figure 3:
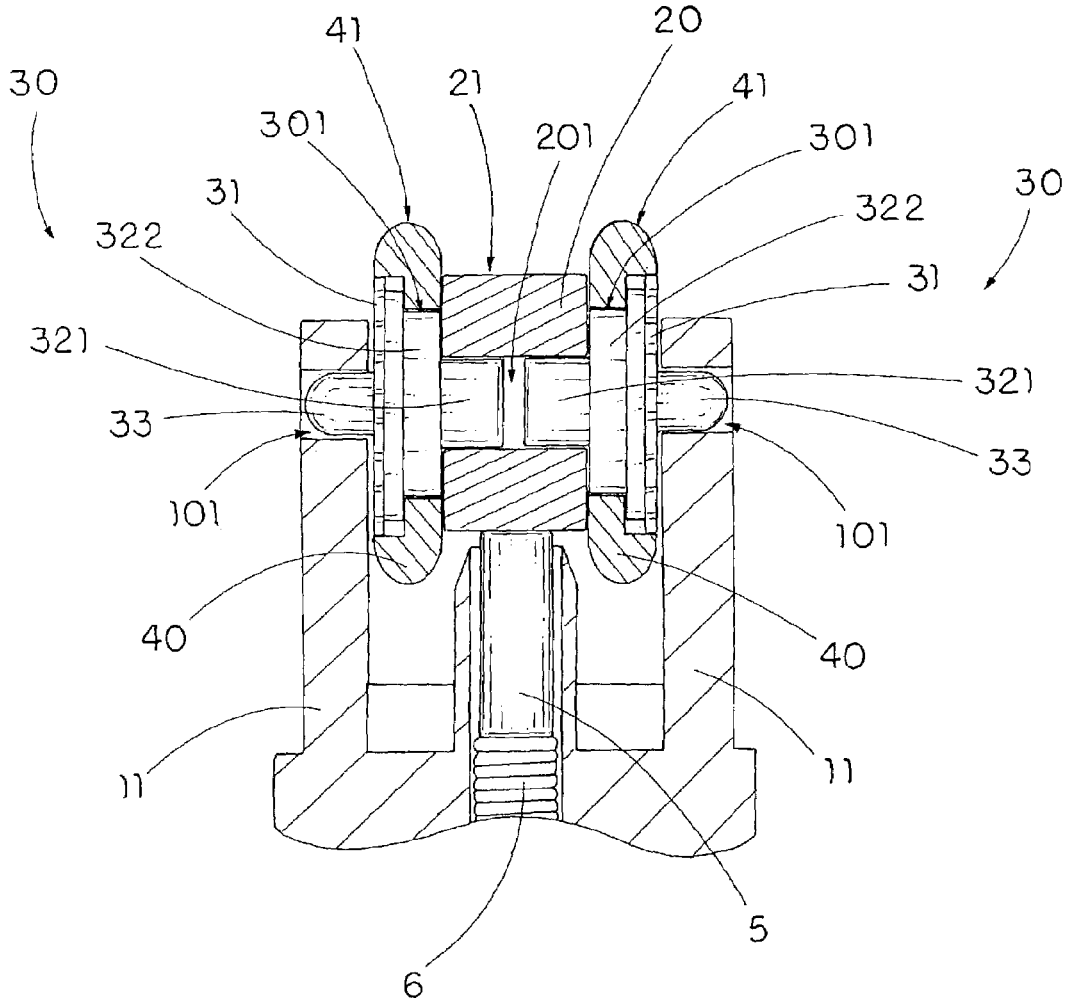
FIG. 3 is a sectional view of the ignition unit for the disposable childproof lighter according to the above preferred embodiment of the present invention.

Accordingly, a total thickness of the gear wheel 31 and the support wheel 322 is preferred to be equal to or slightly less than a distance between the respective supporting wall 10 and the opposing side of the striker wheel 20, as shown in FIG. 3.

As shown in FIGS. 2 and 3, the slipping surface 41 of each of the driving caps 40 is radially projected to form a round outer circumferential surface of the driving ring 401 for enhancing a contacting area thereof, wherein a thickness of the driving ring 401 is gradually reduced from a mid-portion to two outer edges thereof so as to form the round outer circumferential slipping surface 41 of the driving cap 40. Due to the shape of the slipping surfaces 41 of the driving caps 40, the adult is able to deform his or her thumb to enlarge the contacting area between the thumb's surface and the slipping surfaces 41 of the driving caps 40. However, the young child, who has a smaller thumb size, is unable to ignite the disposable childproof lighter since his or her thumb cannot frictionally engage with the slipping surfaces 41 of the driving caps 40 to rotate the striker wheel 20. In addition, the round shape of the slipping surfaces 41 of the driving caps 40 can prevent the young child striking the driving caps 41 on the floor to rotate the striker wheel 20 for ignition.

The adult's user must press his or her thumb on the slipping surfaces 41 of the driving caps 40 in order to establish sufficient gripping friction between the thumb and the slipping surfaces 41 of the driving caps 40 to drive the striker wheel 20 to rotate. In other words, when an insufficient gripping friction applied by a young child on the driving caps 40, the child's thumb will slip off the driving caps 40 without causing the rotation of the striker wheel 20, so as to prevent the disposable childproof lighter from being ignited by children or accidentally.

A width of each of the supporting gaps 301, which is a width of the support wheel, should be equal to or slightly larger than a thickness of the inner sidewall 44 of each driving cap 40. According to the preferred embodiment, a diameter of the central support hole 440 of each inner sidewall 44 is slightly larger than a diameter of the respective support wheel 322 such that the inner sidewalls 44 of the two driving caps 40 are rotatably disposed in the two supporting gaps 301 respectively so as to hold the two driving caps 40 in a rotatably movable manner. In other words, the two driving caps 40 are freely rotated within the supporting gaps 301 respectively.

Since the diameter of each of the driving cavities 43 is larger than the diameter of the respective gear wheel 31 received therein, the two driving caps 40 are capable of being rotated to idle with respect to the two driven gear elements 30 respectively. In other words, the two driving caps 40 are normally disengaged with the driven gear elements 30 respectively unless a relatively larger force is applied on the slipping surfaces 41 of the driving caps 40 by the adult to downwardly press the two driving caps 40 against the two gear wheels 31 of the two driven gear elements 30 respectively in order to drive the driven gear elements 30 and the striker wheel 20 to rotate. Since the young child does not have sufficient power to press down and rotate the driving caps 40 at the same time, the arrangement of the two driven gear elements 30 and the two driving caps 40 can substantially prevent the young child from driving the striker wheel 20 to rotate and ignite the lighter. It is worth to mention that the ignition unit of the present invention provides a dual safety features in one simple structure, which are the slipping surfaces 41 of the driving caps 40 and the idle rotation of the driving caps 40, so as to prevent any unwanted ignition of the disposable childproof lighter accidentally or by children.

Figure 4:
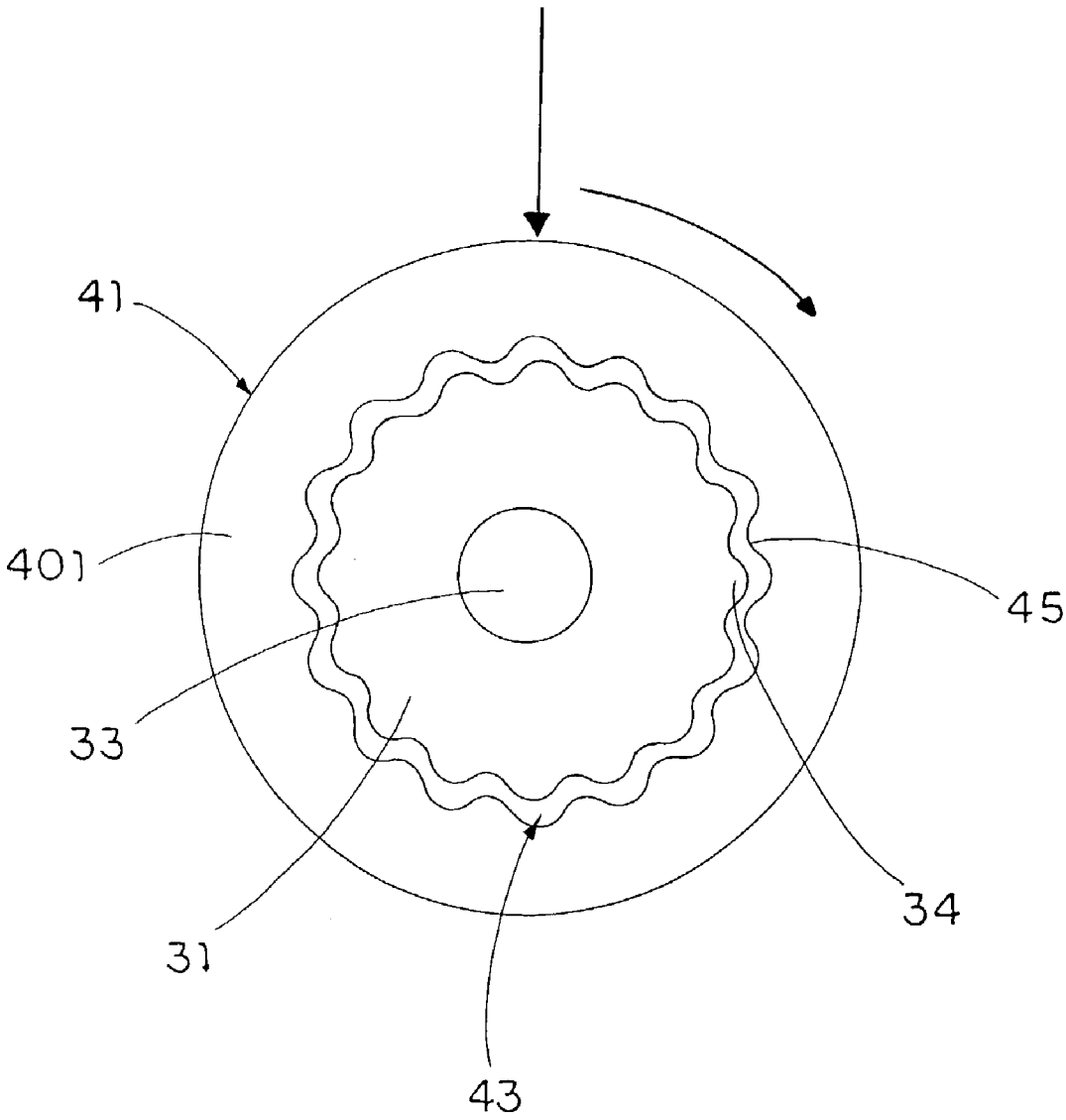
FIG. 4 is a side sectional view of the ignition unit for the disposable childproof lighter according to the above preferred embodiment of the present invention.

In order to enhance the engagements between the two driving caps 40 and the two driven gear elements 30 respectively, the ignition unit further comprises a plurality of driven gear teeth 34 spacedly provided on the outer circumferential surface 310 of each gear wheel 31 and a plurality of driving teeth 45 spacedly provided on the inner circumferential surface 42 of each driving cap 40, as shown in FIG. 4, wherein when the driving caps 40 are pressed to engage the driving teeth 45 with the driven gear teeth 34, the driving caps 40 are capable of driving the gear wheels 31 to rotate, so as to rotate the striker wheel 20 for ignition.

Accordingly, the driven gear teeth 34 are spacedly and outwardly protruded from an outer edge of the outer circumferential surface 310 of the gear wheel 31 of each of the driven gear elements 30. Correspondingly, the driving teeth 45 of the driving caps 40 can also be arranged spacedly with respect to the driven gear teeth 34, so that when the driving caps 40 are pressed down by a downward force, one of the driving teeth 45 of each of the driving caps 40 will be pressed to engage with at least one of the upper driven gear teeth 34 of the respective gear wheels 31 for driving the driven gear elements 30 and the striker wheel 20 to rotate.

In addition, since the inner sidewall 44 of each of the driving caps 44 is sandwiched between the striker wheel 20 and the gear wheel 31 of the respective driven gear element 30, the driving caps 40 are rotatably held between the striker wheel 20 and the two driven gear elements 30 so as to prevent any unwanted axial loose of the driving caps 40 for ensuring the precise engagement between the driving caps 40 and the driven gear elements 30 when the downward force is applied on the driving caps 40.

In fact, during assemble, the two driving caps must be coaxially aligned at two sides of the striker wheel 20 with the two driving cavities 43 facing outward, and then by plugging the two wheel axles 321 of the two support shanks 32 into the two ends of the central axial hole 201 of the striker wheel 20 until the two gear wheels 31 of the two gear wheels 31 of the two driven gear elements 30 are received in the two driving cavities 43 respectively, as shown in FIG. 3. Therefore, it is impossible to detach the driving caps 40 from the ignition unit after the assembly thereof, so as to enhance the safety structure of the disposable childproof lighter.

Figure 5:
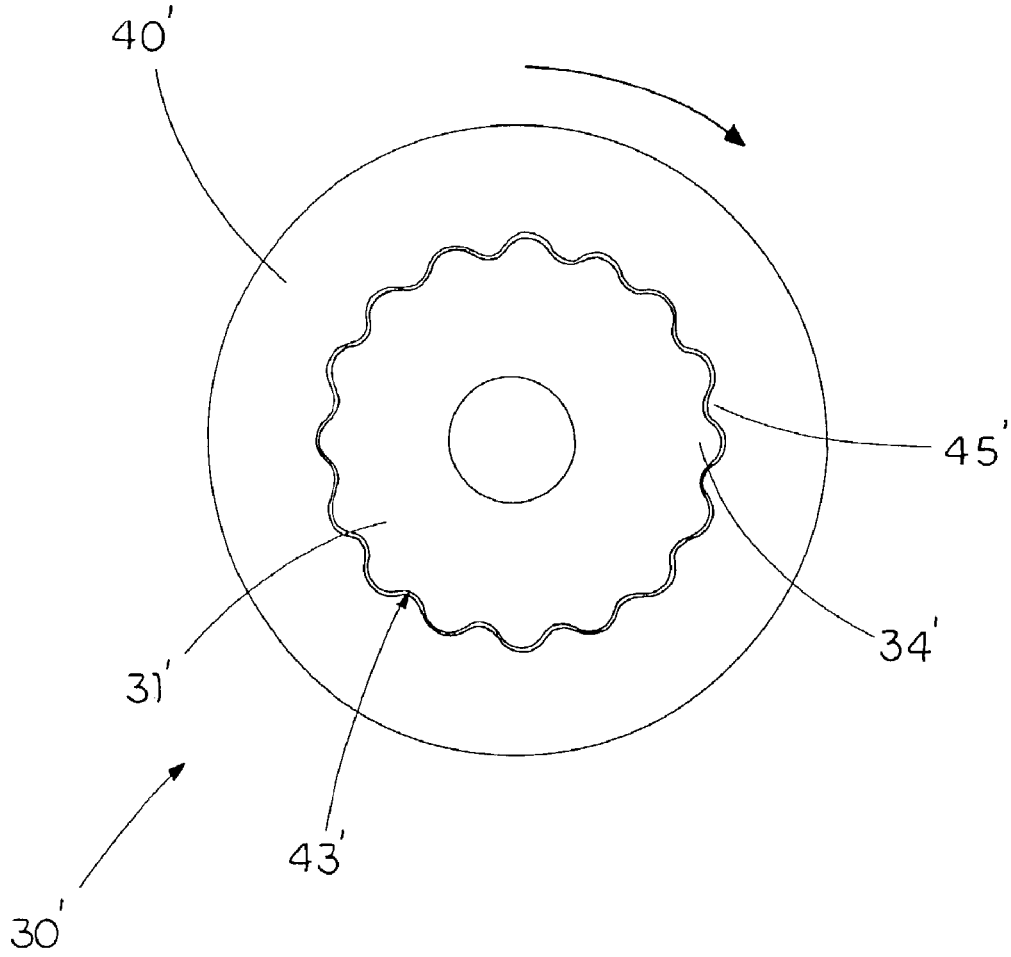
FIG. 5 illustrates an alternative mode of the ignition unit for the disposable childproof lighter according to the above preferred embodiment of the present invention.

FIG. 5 illustrates an alternative mode of the ignition unit wherein the structural design of the ignition unit is remained the same except that the driving caps 40' are normally engaged with the driven gear elements 30' respectively. In other words, the driving caps 40' are not run idle at normal position.

In order to maintain the engagement between the driving caps 40' and the driven gear elements 30' at the normal position, the structural design of each of the driving caps 40' can be simply modified that the diameter of the driving cavity 43' of each driving cap 40' is reduced with respect to the gear wheel 31 ' of the respective driven gear element 30'.

As shown in FIG. 5, the driving cavity 43' of each of the driving caps 40' has a predetermined diameter that when the gear wheel 31' of the respective driven gear element 30' is received in the driving cavity 43', the driving teeth 45' of the driving caps 40' are engaged with the driven gear teeth 34' of the gear wheel 31 ' of each of the driven gear elements 30' in such a manner that when the driving caps 40' are rotated to drive the driven gear elements 30' as well as the striker wheel 20 to rotate for ignition.

In other words, by simply varying the size of the driving cap 40, 40', the driving caps 40 are capable of freely rotating about the driven gear elements 30 respectively or the driving caps 40' are normally engaged with the driven gear elements 30'. Therefore, the manufacturing cost of the ignition unit of the present invention can be substantially reduced to provide different safety features for the disposable childproof lighter without altering the original design of the ignition unit.

In addition, the ignition unit of the present invention is capable of incorporating with any disposable childproof lighter having the flint 5 without altering the original structure of the disposable childproof lighter.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An ignition unit for a disposable childproof lighter which comprises two supporting walls and a flint supported by a resilient element at a position between said two supporting walls and a flint supported by a resilient element at a position between said two supporting walls, wherein said ignition unit, which is adapted for rotatably mounting between said two supporting walls, comprises:

a striker wheel having a plurality of striking teeth evenly provided on an outer circumferential surface thereof for urging against said flint;

a pair of driven gear elements for coaxially mounting said striker wheel between said two supporting walls, wherein each of said driven gear elements comprises a gear wheel having an outer circumferential surface and a support shank integrally and coaxially protruded from an inner side of said gear wheel, wherein said two support shanks, which are smaller than said two gear wheels in diameter, are coaxially mounted on two sides of said striker wheel to define two supporting gaps between said two sides of said striker wheel and said two gear wheels respectively, and said two gear wheels are arranged for respectively and rotatably mounting to said two supporting walls in such a manner that said striker wheel is capable of being driven to rotate when said two gear wheels are driven to rotate;

a pair of driving caps, each comprising a driving ring and an inner sidewall extending from a circular edge of said driving ring, wherein each of said driving ring has a smooth outer circumferential slipping surface, an inner circumferential surface, and a circular driving cavity formed within said driving ring and said inner sidewall, each of said driving cavities having a diameter larger than that of said gear wheels of said driven gear elements, and a plurality of driven gear teeth spacedly provided on said outer circumferential surface of each of said gear wheels and a plurality of driving teeth which are spacedly provided on said inner circumferential surface of each of said driving caps and are normally engaged said driven gear teeth respectively, such that said gear wheels are driven to rotate by said driving caps, wherein said slipping surface of each of said driving caps, having a round shaped, is radially projected to form said outer circumferential surface of said driving ring, wherein a thickness of said driving ring is gradually reduced from a mid-portion to two outer edges thereof so as to form said round slipping surface of said driving cap, such that said slipping surfaces of said driving caps enhance a contacting area for an adult's thumb pressing thereon and arrange for preventing a young child from frictionally engaging with said driving caps, wherein each of said inner sidewalls has a central support hole for said support shank of said respective driven gear element passing through while said respective gear wheel is received in said driving cavity, wherein said two inner sidewalls of said driving caps are disposed between said two supporting gaps respectively so as to hold said two driving caps in a position between said striker wheel and said two driven gear elements respectively, wherein said two driving caps are normally engaged with said gear wheels of said driven gear elements respectively in such a manner that when said driving caps are intentionally rotated, said driven gear elements and said striker wheel are driven to rotate, so as to drive said striker wheel to rotate for striking against said flint to produce sparks.

2. The ignition unit, as recited in claim 1, wherein each of said support shanks comprises a wheel axle and a support wheel which is integrally and coaxially positioned between said gear wheel and said wheel axle, said two wheel axles, which are smaller than said two gear wheels in diameter, being coaxially fitted into two ends of a central axial hole of said striker wheel respectively, each of said two support wheels having a diameter larger than said two wheels axles, wherein when said two wheel axles are fully plugged into said two ends of said central axial hole of said striker wheel, said two supporting gaps are defined between said two sides of said striker wheel and said two gear wheels respectively, and that said inner sidewall of each of said driving caps is sandwiched between said striker wheel and said gear wheel of said respective driven gear element.

3. The ignition unit, as recited in claim 2, wherein each of said driven gear elements further comprises a supporting shaft coaxially and outwardly extended from said respective gear wheel, wherein said two supporting shafts of said driven gear elements are arranged for rotatably inserting into two supporting hole of said two supporting walls respectively so as to rotatably mount said striker wheel between said two supporting walls.

4. An ignition unit for a disposable childproof lighter which comprises two supporting walls and a flint supported by a resilient element at a position between said two supporting walls and a flint supported by a resilient element at a position between said two supporting walls, wherein said ignition unit, which is adapted for rotatably mounting between said two supporting walls, comprises:

a striker wheel having a plurality of striking teeth evenly provided on an outer circumferential surface thereof for urging against said flint;

a pair of driven gear elements for coaxially mounting said striker wheel between said two supporting walls, wherein each of said driven gear elements comprises a gear wheel having an outer circumferential surface and a support shank integrally and coaxially protruded from an inner side of said gear wheel, wherein said two support shanks, which are smaller than said two gear wheels in diameter, are coaxially mounted on two sides of said striker wheel to define two supporting gaps between said two sides of said striker wheel and said two gear wheels respectively, and said two gear wheels are arranged for respectively and rotatably mounting to said two supporting walls in such a manner that said striker wheel is capable of being driven to rotate when said two gear wheels are driven to rotate;

a pair of driving caps, each comprising a driving ring and an inner sidewall extending from a circular edge of said driving ring, wherein each of said driving ring has a smooth outer circumferential slipping surface, an inner circumferential surface, and a circular driving cavity formed within said driving ring and said inner sidewall, each of said driving cavities having a diameter larger than that of said gear wheels of said driven gear elements, and a plurality of driven gear teeth spacedly provided on said outer circumferential surface of each of said gear wheels and a plurality of driving teeth spacedly provided on said inner circumferential surface of each of said driving caps, wherein said driving teeth of said free rotating driving cap are normally disengaged with said driven gear teeth of said respective gear wheel unless said downward force is intentionally applied on said respective driving cap to engage said driven gear teeth with said driving teeth respectively to driven said respective gear wheel to rotate by said respective driving cap, wherein said slipping surface of each of said driving caps, having a round shaped, is radially projected to form said outer circumferential surface of said driving ring, wherein a thickness of said driving ring is gradually reduced from a mid-portion to two outer edges thereof so as to form said round slipping surface of said driving cap, such that said slipping surfaces of said driving caps enhance a contacting area for an adult's thumb pressing thereon and arrange for preventing a young child from frictionally engaging with said driving caps, wherein each of said inner sidewalls has a central support hole for said support shank of said respective driven gear element passing through while said respective gear wheel is received in said driving cavity, wherein said two inner sidewalls of said driving caps are disposed between said two supporting gaps respectively so as to hold said two driving caps in a position between said striker wheel and said two driven gear elements respectively, wherein one of said two driving caps is normally rotated about said respective driven gear element in a free rotatably movable manner unless a downward force is intentionally applied on said respective driving cap, wherein another said driving cap is normally engaged with said respective gear wheel of said driven gear element that said driving teeth of said respective driving cap are normally engaged with said driven gear teeth of said respective gear wheel respectively, wherein said driving cap is rotated to drive said respective driven gear element to rotate, so as to drive said striker wheel to rotate for striking against said flint to produce sparks.

5. The ignition unit, as recited in claim 4, wherein each of said support shanks comprises a wheel axle and a support wheel which is integrally and coaxially positioned between said gear wheel and said wheel axle, said two wheel axles, which are smaller than said two gear wheels in diameter, being coaxially fitted into two ends of a central axial hole of said striker wheel respectively, each of said two support wheels having a diameter larger than said two wheels axles wherein when said two wheel axles are fully plugged into said two ends of said central axial hole of said striker wheel, said two supporting gaps are defined between said two sides of said striker wheel and said two gear wheels respectively, and that said inner sidewall of each of said driving caps is sandwiched between said striker wheel and said gear wheel of said respective driven gear element.

6. The ignition unit, as recited in claim 5, wherein each of said driven gear elements further comprises a supporting shaft coaxially and outwardly extended from said respective gear wheel, wherein said two supporting shafts of said driven gear elements are arranged for rotatably inserting into two supporting hole of said two supporting walls respectively so as to rotatably mount said striker wheel between said two supporting walls.

7. An ignition unit for a disposable childproof lighter which comprises two supporting walls and a flint supported by a resilient element at a position between said two supporting walls and a flint supported by a resilient element at a position between said two supporting walls, wherein said ignition unit, which is adapted for rotatably mounting between said two supporting walls, comprises:

a striker wheel having a plurality of striking teeth evenly provided on an outer circumferential surface thereof for urging against said flint;

a pair of driven gear elements for coaxially mounting said striker wheel between said two supporting walls, wherein each of said driven gear elements comprises a gear wheel having an outer circumferential surface and a support shank integrally and coaxially protruded from an inner side of said gear wheel, wherein said two support shanks, which are smaller than said two gear wheels in diameter, are coaxially mounted on two sides of said striker wheel to define two supporting gaps between said two sides of said striker wheel and said two gear wheels respectively, and said two gear wheels are arranged for respectively and rotatably mounting to said two supporting walls in such a manner that said striker wheel is capable of being driven to rotate when said two gear wheels are driven to rotate;

a pair of driving caps, each comprising a driving ring and an inner sidewall extending from a circular edge of said driving ring, wherein each of said driving ring has a smooth outer circumferential slipping surface, an inner circumferential surface, and a circular driving cavity formed within said driving ring and said inner sidewall, each of said driving cavities having a diameter larger than that of said gear wheels of said driven gear elements, and a plurality of driven gear teeth spacedly provided on said outer circumferential surface of each of said gear wheels and a plurality of driving teeth spacedly provided on said inner circumferential surface of each of said driving caps, wherein said gear wheels are driven to rotate by said driving caps when said driven gear teeth are engaged with said driving teeth respectively, wherein said slipping surface of each of said driving caps, having a round shaped, is radially projected to form said outer circumferential surface of said driving ring, wherein a thickness of said driving ring is gradually reduced from a mid-portion to two outer edges thereof so as to form said round slipping surface of said driving cap, such that said slipping surfaces of said driving caps enhance a contacting area for an adult's thumb pressing thereon and arrange for preventing a young child from frictionally engaging with said driving caps, wherein each of said inner sidewalls has a central support hole for said support shank of said respective driven gear element passing through while said respective gear wheel is received in said driving cavity, wherein said two inner sidewalls of said driving caps are disposed between said two supporting gaps respectively so as to hold said two driving caps in a position between said striker wheel and said two driven gear elements respectively, wherein said driving caps are arranged to engage with said gear wheels to drive said driven gear elements to rotate respectively, wherein said two driving caps are normally and respectively rotated about said two driven gear elements in a free rotatably movable manner unless a downward force is intentionally applied on said driving caps while rotating said driving caps to drive said driven gear elements and said striker wheel to rotate, so as to drive said striker wheel to rotate for striking against said flint to produce sparks.

8. The ignition unit, as recited in claim 7, wherein each of said support shanks comprises a wheel axle and a support wheel which is integrally and coaxially positioned between said gear wheel and said wheel axle, said two wheel axles, which are smaller than said two gear wheels in diameter, being coaxially fitted into two ends of a central axial hole of said striker wheel respectively, each of said two support wheels having a diameter larger than said two wheels axles, wherein when said two wheel axles are fully plugged into said two ends of said central axial hole of said striker wheel, said two supporting gaps are defined between said two sides of said striker wheel and said two gear wheels respectively, and that said inner sidewall of each of said driving caps is sandwiched between said striker wheel and said gear wheel of said respective driven gear element.

9. The ignition unit, as recited in claim 8, wherein each of said driven gear elements further comprises a supporting shaft coaxially and outwardly extended from said respective gear wheel, wherein said two supporting shafts of said driven gear elements are arranged for rotatably inserting into two supporting hole of said two supporting walls respectively so as to rotatably mount said striker wheel between said two supporting walls.

* * * * *